US007004408B2

(12) United States Patent
Vecchiet et al.

(10) Patent No.: US 7,004,408 B2
(45) Date of Patent: Feb. 28, 2006

(54) BURNER

(75) Inventors: Fabio Vecchiet, Villa Vicentina (IT); Milorad Pavlicevic, Udine (IT); Alfredo Poloni, Fogliano Redipuglia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 10/508,608

(22) PCT Filed: Mar. 21, 2003

(86) PCT No.: PCT/EP03/02968

§ 371 (c)(1),
(2), (4) Date: Sep. 22, 2004

(87) PCT Pub. No.: WO03/081136

PCT Pub. Date: Oct. 2, 2003

(65) Prior Publication Data

US 2005/0173566 A1 Aug. 11, 2005

(30) Foreign Application Priority Data

Mar. 22, 2002 (IT) ..... MI2002A0611

(51) Int. Cl.
*B05B 1/14* (2006.01)

(52) U.S. Cl. ..... 239/558; 239/399; 239/400; 239/403; 239/418; 239/433; 239/557; 239/556; 431/181; 431/187; 431/353

(58) Field of Classification Search ..... 239/399, 239/400, 403, 418, 422, 424, 428, 433, 497, 239/556, 557, 558; 431/181, 182, 187, 351, 431/353

See application file for complete search history.

(56) References Cited

U.S. PATENT DOCUMENTS

| | | | | |
|---|---|---|---|---|
| 3,685,740 | A | 8/1972 | Shepherd | |
| 5,158,443 | A * | 10/1992 | Miyake | 239/399 |
| 5,176,324 | A * | 1/1993 | Furuse et al. | 239/433 |
| 5,882,184 | A * | 3/1999 | Feldermann | 431/187 |
| 5,944,507 | A * | 8/1999 | Feldermann | 239/424 |
| 6,142,765 | A * | 11/2000 | Ramaseder et al. | 431/9 |
| 6,389,998 | B1 * | 5/2002 | Mukai et al. | 239/428 |

FOREIGN PATENT DOCUMENTS

| | | |
|---|---|---|
| EP | 0674135 | 3/1995 |
| EP | 0775868 | 5/1997 |
| FR | 1438494 | 3/1965 |

* cited by examiner

*Primary Examiner*—Steven J. Ganey
(74) *Attorney, Agent, or Firm*—Sampson & Associates, P.C.

(57) ABSTRACT

Burner (1) comprising a head (2) with two groups of holes (4', 4") for the passage of fuel and comburent arranged in circles concentric to the burner axis, in which the various groups (5) of holes are separated by circular sectors without holes and the axes of the holes are oblique compared with the burner axis (X) to create special forms of flame.

9 Claims, 6 Drawing Sheets

BURNER

This application claims priority to International Patent Application Serial No. PCT/EP03/02968 filed on 21 Mar. 2003, claiming priority to Italian Patent Application Serial No. MI12002A000611 filed on 22 Mar. 2002.

FIELD OF THE INVENTION

This invention refers to a burner for use in the iron and steel industry for heating or as an aid for other means of heating metal during a melting process.

BACKGROUND ART

Burners are widely used in the iron and steel industry, and are used especially in melting processes for the production of steel or other metals, such as in electric arc furnaces (EAF) for heating and melting metal, to increase the productivity of the process and to reduce the consumption of electricity. They are used particularly on rolling lines in furnaces for continuous heating of the molten product. Another particular use of burners is in pre-heating systems for system components, such as ladles, tundishes, etc. But today burners are also used in other fields, including the incineration of solid urban waste.

EAF in which burners are used often suffer from restrictions due to the poor distribution of heat created by traditional burners. A type of burner which is commonly used in EAF is the concentrated flame burner, which offers a poor mixing capacity and oxidises scrap. Observation shows the presence of large quantities of methane and free oxygen in the furnace, reaching a considerable distance from the burner head.

Traditional burners have large portions of free oxygen in the flame and this feature, together with the localised heating effect of the burner on the scrap makes them perfect for oxygen cutting of scrap, but not for evenly distributed heating. The oxidisation of the scrap causes serious disturbance to the overall energy balance of the melting process.

The concentration of the flame produced by these burners causes other disadvantages. The volume of scrap heated remains limited, while there is often perforation in the scrap up to the electric arc area, disturbing the arc and causing combust gas to rise up the electrode without passing through the scrap, which is not efficiently heated. Moreover, the ring of scrap at the base of the column in the furnace is pre-heated discontinuously meaning that a higher number of burners have to be installed in the furnace.

A burner of this kind is disclosed in document FR-A-1438494, whereby a concentrated flame is produced by the burner head so that the flame envelope has the shape of an annulus. This burner produces thus a heat concentration in a narrow cylindrical volume in front of the burner. From using this burner it ensues that the heat produced is not efficiently used during the whole stage of scrap melting.

SUMMARY OF THE INVENTION

A primary aim of this invention is to overcome the aforementioned problems by providing a burner which avoids them and improves the energy balance in the furnace in which it is used.

These aims and others that become apparent in the light of the following description, are achieved by means of a burner for electric arc melting furnaces having the features of claim 1. Preferred characteristics of the burner according to the invention are described in the dependent claims.

Thanks to the conformation of the holes on the head, the burner can produce any shape of flame. Another advantage is the ease with which the burner heads according to the invention can be adapted to known burners with standard features, allowing considerable savings on system running costs. The burner is comprises a cylindrical body made with simple concentric pipes connected to a cylindrical copper head. The burner is built in a way similar to that used for all traditional burners normally used in EAF and is therefore compatible with existing systems.

The burner according to the invention offers several advantages compared with the traditional type. There is minimum oxidisation of the scrap thanks to an optimal blending, a lack of areas rich in oxygen and reduced velocity of the produced flame. The scrap is melted down by the heat produced by the flame and not by oxygen cutting, with an uniform distribution of heat and reduced oxidisation of the scrap, benefiting in terms of the overall energy balance of the melting process in the furnace.

The volume of heated scrap is 3 to 4 times greater than by means traditional concentrated burners. The injection of the flame is softer and better distributed making it possible not to perforate the scrap up to the electric arc area, avoiding the risk of disturbing the electric arc and preventing the combust gas from rising up the electrode, without passing through the scrap.

It is possible to preheat the whole ring of scrap at the base of the column in the furnace without leaving discontinuity areas, with less units installed.

The hot gas produced by the burner rises more slowly and evenly up the scrap and has more time to release its energy to the iron scrap.

With the same number of burners it is possible to install more power without risking concentration of energy in limited areas, maintaining continuous preheating across the whole circumference of the furnace.

Advantageously, the orientation of the axes of the burner holes with respect to the axis of the burner itself is chosen in order to generate divergent flames and flame envelopes of various shapes. The shape can be chosen in view of an optimal heat distribution in the scrap layer during the whole stage of scrap melting.

A particularly advantageous flame shape is the one with a flat and wide flame envelope. This solution offers an optimal use of the heat produced, whereby the cavity produced by the flame of the burner lasts for a longer part of the scrap melting phase, before an aperture is produced in the part just above the flame.

Avoiding such an aperture above the flame, is an important advantage as through this aperture part of the heat flows directly in the upper furnace atmosphere without thermal exchange with the scrap.

BRIEF DESCRIPTION OF THE DRAWINGS

Further characteristics and advantages of the invention will appear from following the detailed description of a preferred but not exclusive embodiments of burner for electric arc melt furnace shown by way of non-limiting examples with reference to the accompanying drawings in which.

DETAILED DESCRIPTION OF PREFERRED FORMS OF REALISATION

Figure 1:
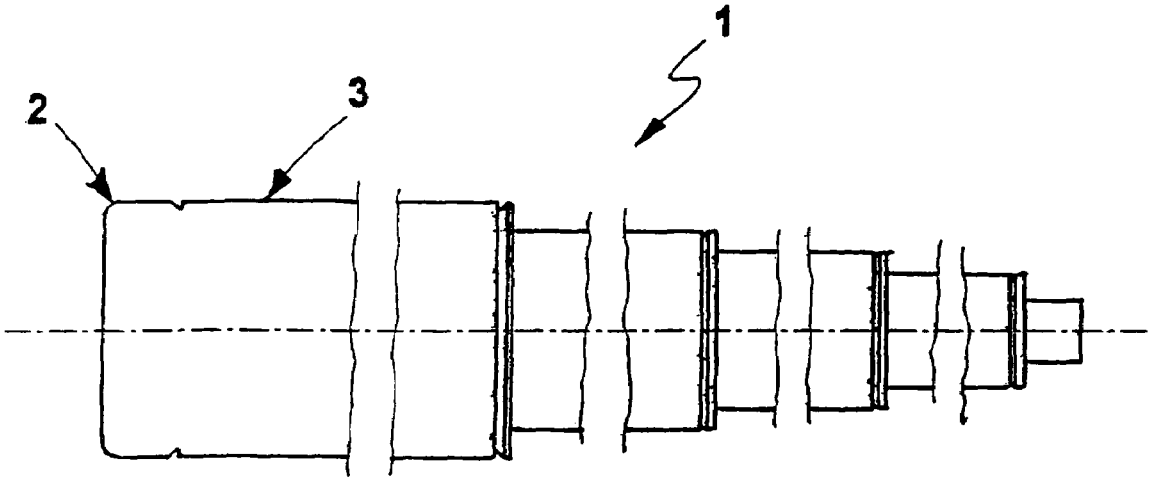
FIG. 1 represents the lateral view of the invented burner.
Figure 2:
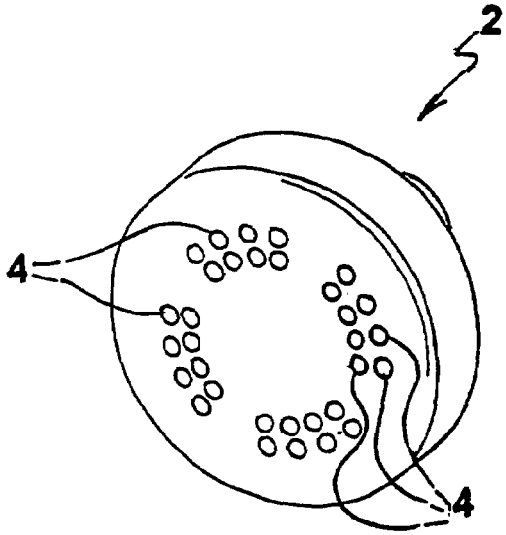
FIG. 2 represents the prospect of the enlarged head of the burner in FIG. 1.
Figure 3:
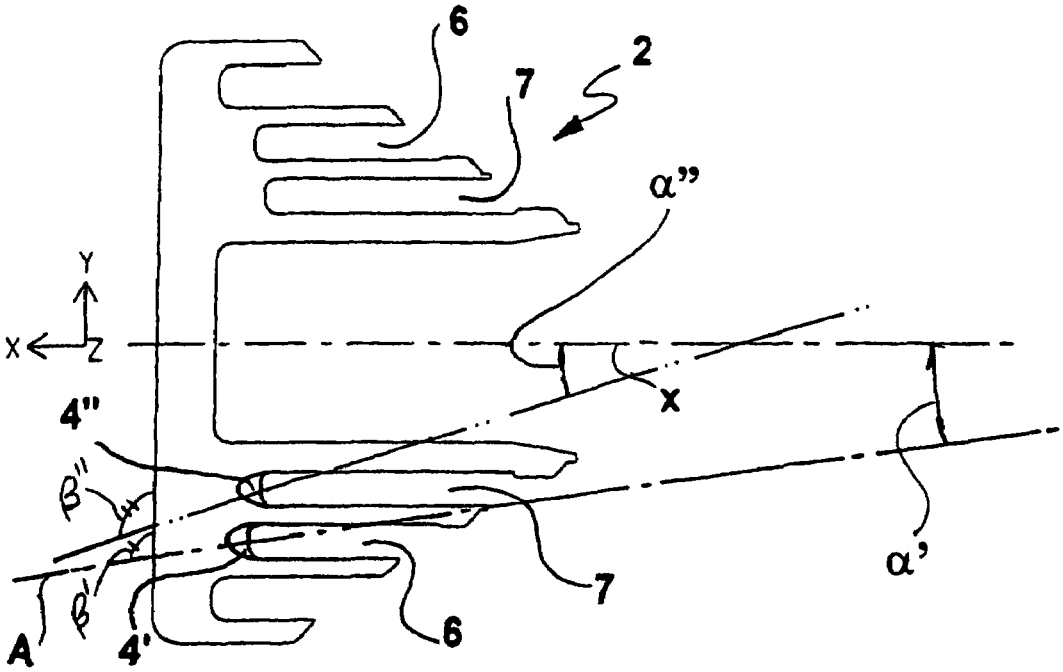
FIG. 3 represents the cross section along the axial plane of the head in FIG. 2.

With particular reference to FIG. 1, a burner for the production of heat in an electric arc furnace, globally indicated with numeral 1, comprises a head 2 made of suitable material, usually copper, and a cylindrical body 3. The head 2, shown enlarged in FIGS. 2, 3 and 4, has several holes 4, arranged along circumferences, or arcs of circumference concentric to the axis X of the head and of the burner. The cylindrical body 3 of the burner 1 is made up of several coaxial pipes fitted inside one another, with a structure of well-known type which is not described in further detail.

In the embodiments shown in the Figures, the head 2 has two annular chambers 7 and 6 to feed the fuel (e.g. methane) and the comburent (e.g.: oxygen) to the burner 1. There are also variants of this invention with more annular chambers. On the root circle of chamber 6 there are provided holes 4', whose axis forms a first angle $\alpha'$, with value comprised between 5° and 60°, with respect to the axis X, and forms a second angle $\beta'$, with value comprised between 5° and 60°, with respect to the plane passing through axis X and through the point defined by the intersection of axis A of the hole with the outer surface of the head 2.

Similarly, the extremity of chamber 7 has holes 4", whose respective axis forms an angle $\alpha''$, with value comprised between 5° and 60°, with respect to the axis X, and forms an angle $\beta''$, with value comprised between 5° and 60°, with respect to the plane passing both through the axis X and through the point defined by the intersection of the hole axis A with the outer surface of the head 2. The angles $\alpha'$, $\beta'$ can have the same or different values compared with angles $\alpha''$, $\beta''$ depending on the effects and shapes of flame required.

Figure 5:
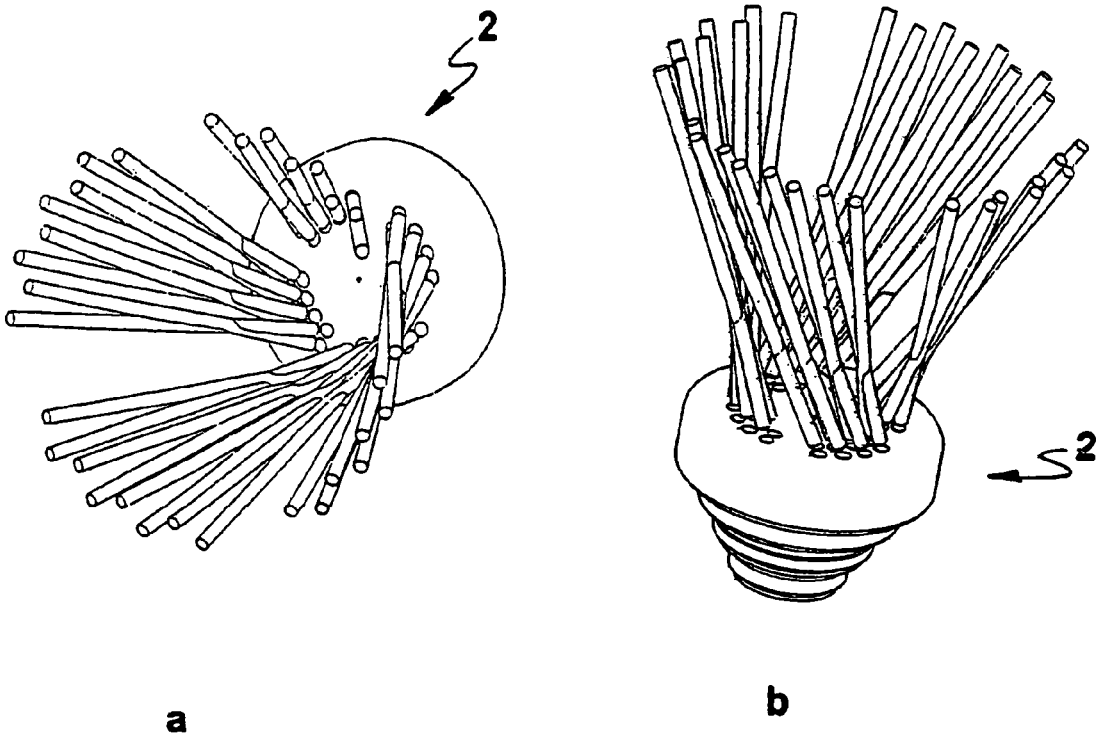
FIG. 5*a* represents a schematic prospect of part of a first embodiment of the burner in FIG. 1 in operation, shown from a particular angle, highlighting the directions of the jets produced by the holes in the head.
FIG. 5*b* represents a schematic prospect of part a first embodiment of the burner in FIG. 5*a*, shown from a different angle.

The position of the holes 4' and 4" on the root circle of the respective chamber 6, 7 and inclination angles $\alpha'$, $\beta'$, $\alpha''$, $\beta''$ of the holes axis are chosen in such a way that the jets of comburent and fuel delivered by the holes 4' and 4" reciprocally intersect in order to properly blend the fuel with the comburent. This mixing effect is schematically shown in FIGS. 5*a* and 5*b*.

Figure 4:
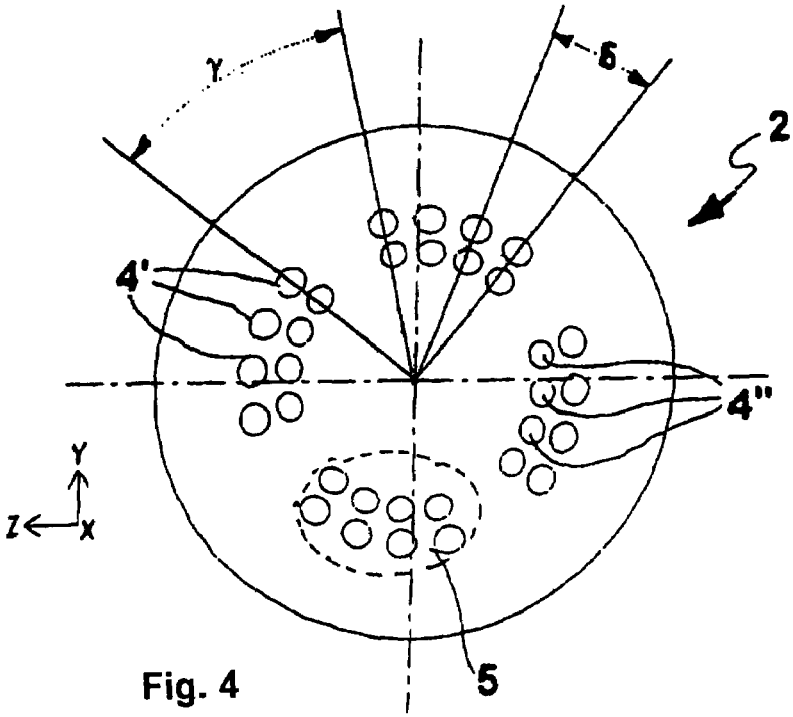
FIG. 4 represents a front view of the burner in FIG. 1.

With particular reference to FIG. 4, the holes 4' and 4" are positioned in such a manner that the reciprocal position of the centres of two adjacent holes, seen from the front, is a distance of an angle $\delta$, with the vertex on axis X of the burner. The holes are grouped together so as to include the holes 4' for the passage of comburent and the holes 4" for the passage of fuel in each group 5. The head is provided with several groups 5 of holes, separated by circular sectors with angle $\gamma$, whose vertex coincides with axis X of the burner. In these sectors no holes are provided.

Both the number of comburent holes and that of fuel holes in each group 5, and the number of groups, may vary according to needs. The groups of holes 5 can each have different numbers, diameters and spaces $\delta$ of holes. The groups of holes 5 can be spaced two by two with different angles $\gamma$. The angles $\alpha'$, $\alpha''$ e $\beta'$, $\beta''$ of the inclination of the holes axes can differ from group to group. In the embodiment of the burner head 2 shown in FIGS. 5*a* and 5*b*, having one chamber for comburent, one chamber for fuel and 4 groups of holes, each with 4 holes for oxygen and 4 holes for methane which are all the same and evenly spaced, it is possible to see how the jets of oxygen and methane collide perfectly, two by two, creating an optimum mixture of fuel and comburent.

The burner according to the invention has thermofluid-dynamic characteristics which are particularly advantageous for the following reasons.

In the preferred embodiment in which the holes are arranged in groups, the shape of the flame produced by the burner 1 is regulated by the physical effect of the swirl induced by the inclination of the holes, which tends to widen the flame, which combines with the effect produced by the degree of independence of the flows produced by each group of holes 5, the intensity of which depends on the angle $\gamma$ of spacing between them.

The arrangement of the 4', 4" holes in separate groups reciprocally spaced produces an effect which enables the flame to widen continuously and prevents it from narrowing. The annular flame produced by a head without spacing between the groups of holes widens, inducing an internal depression. The momentum of the jets near the head enables the creation of a depression in the middle, near the axis of the burner, which is not directly fed by the gases. Moving away from the head, the momentum of the jets is no longer sufficient to maintain the depression and the flames collapses inwardly.

Figure 7:
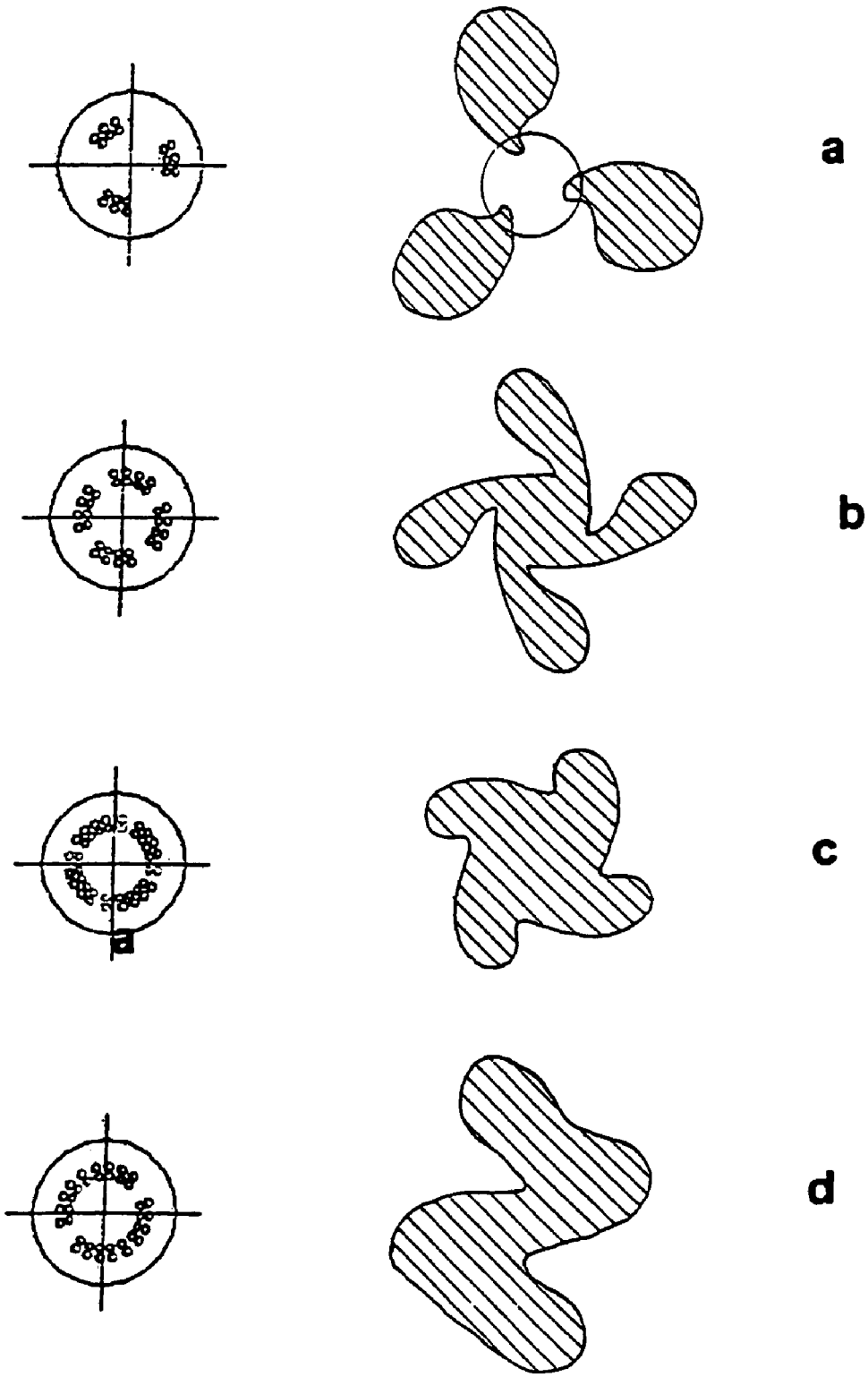
FIGS. 7*a*, 7*b*, 7*c* and 7*d* represent further embodiments of the burner according to the invention, showing the tracks produced by the respective flames

FIG. 7*a* shows a burner with three groups of holes, evenly spaced at intervals of 120°, each group made up of three holes for oxygen and three for methane. The resulting flow has three completely separate areas of flame and their widening follows the direction of the holes. The spacing of the groups is determined so that the flow produced by each one is practically independent. There is a slight swirl effect which gives the jets a propeller-type spatial configuration. In the space between the groups of holes, the environmental gas is able to flow, drawn by the action of the flows produced by the separate groups of holes, feeding the axial region of the burner. In this way the flows produced by each group can expand in the space following the direction determined by the inclination of the holes. The fluid-dynamic connection between the surrounding environment and the axial region of the burner avoids the creation of a central depression, which would cause the flame to collapse.

In accordance with the invention, it is possible to design burners that generate a flame which is the sum of several flows/flames with a predefined degree of independence between one another, characterised by the geometric separation between the groups of holes.

The form of the flame in the space is regulated in terms of height and width by the effect of the swirl of the holes and the distance between the groups. If the distance between the groups is regular, a periodical cylindrical flame is created; if the distance of the groups is variable, a non-periodical flame is created.

Like the embodiments in FIG. 7*a*, the embodiments of the burner according to the invention shown in FIGS. 7*b*, 7*c*, and 7*d* have an external crown of holes for comburent and an internal one for fuel, with holes of the same diameter in all cases. All the holes, both for methane and oxygen, are skewed with respect to the axis of the head by angles α' and α", of the same value, and β' e β" which have also the same value.

FIG. 7*b* shows a burner with four groups of holes, each made up of four external holes for comburent and four internal ones for fuel, evenly spaced at intervals of 90°. The resulting flow has four flame areas which are partially reciprocally interacting due to the fact that the swirl associated with the reduced separation γ between the groups of holes determines the re-circulation of the combustion products towards the burner axis area. In this way it is possible to identify five main flame directions. The width of the four external flames is less than the geometric direction of the holes.

The variant of the burner shown in FIG. 7*c* differs from the previous variant inasmuch as it has a pair of holes for fuel and for comburent positioned intermediately between the groups of the burner shown in FIG. 7*b*. The flame is isomorphic compared with that of the burner in FIG. 7*b* but is more compact and has a more obvious interaction of the flows produced by the groups. In this case the width of the flame is smaller than the width of the flame of the burner of FIG. 7*b*.

FIG. 7*d* shows a burner with two separate groups of holes, each having nine external holes for oxygen and nine internal ones for methane. In this case two flat flames are produced and these interact with one another in the central area giving the flame a characteristic Z shape when seen in cross-section.

In all the cases shown, the flame rotates in the space, increasing in efficiency as it gradually moves away from the head.

Burners with groups of holes differing in terms of number, distribution, direction and diameter of holes, as well as burners with groups spaced differently, generate flames without any cylindrical periodicity.

Figure 6:
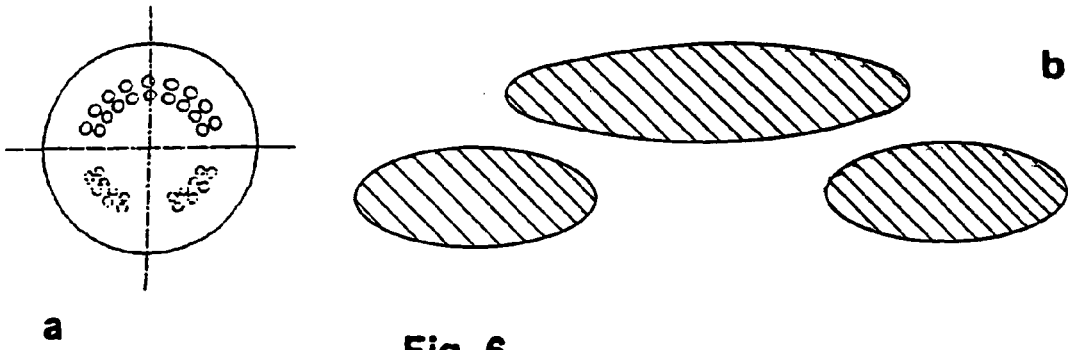
FIG. 6*a* represents a front view of a second embodiment of the burner according to the invention.
FIG. 6*b* represents a schematic cross section of the track drawn by the flame produced by the burner shown in FIG. 6*a,*

Another embodiment of the burner according to the invention is shown in FIG. 6*a*. This embodiment has an upper group of holes, which generates a flat flame, and two lower vertically symmetrical groups, which generate two independent flames diverging downwards, whose cross-section is shown schematically in FIG. 6*b*.

According to a second embodiment of the invention, in which the holes are arranged regularly around the circumference and are not grouped together, the results obtained are less efficient. If the 4' and 4" holes are evenly and continuously distributed around axis X of the burner and if they are close together, with the same inclination of comburent and fuel holes, the presence of the swirl effect alone produces a flame which is not so wide. In this case, the flame widens as it leaves the head, depending on the vector induced by the swirl, but collapses in on itself just a short distance away from the head. This happens because, at a certain distance from the head, the momentum of the jets is dissipated and is unable to maintain the depression in the axial region. Consequently the flame narrows and becomes concentrated again. However, this embodiment offers the advantage of better mixing of the reactants delivered by the head than that of traditional burners.

In general, the swirl effect, together with the fact that the jets of comburent and fuel are directed so that they collide with one another two by two, determines optimum mixing of the reactants so the burner develops almost all its power at shorter distances from the burner head with respect to known burners.

Figure 8:
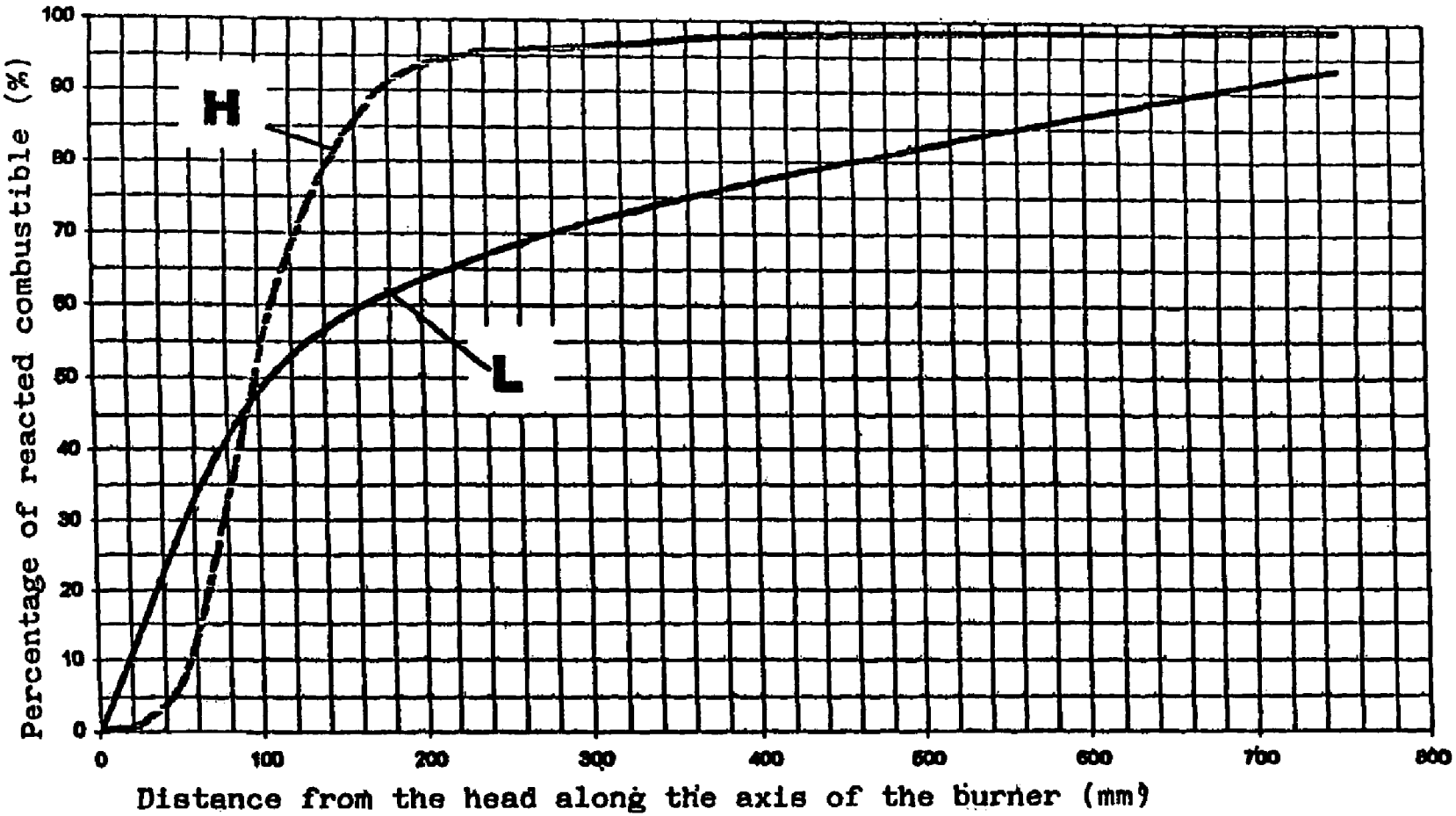
FIG. 8 represents the curve outlining the percentage of reacted fuel in accordance with the distance from a head according to the invention, compared with a head of the state of the art.

FIG. 8 shows a graph that enables comparison of the percentage of methane reacted with oxygen depending on the distance from the head along the axis for the burner invented, represented by curve H, and for a traditional burner for use in EAF, represented by curve L.

The graph shows that the invented burner exhausts the combustion reaction at a distance of 200–300 mm from the head, while a conventional burner needs a distance of over 700 mm to have the same combustion reaction exhaustion effect.

This behaviour of the flame conjoined with the particular morphology assumed in the space is at the origin of all the advantages mentioned earlier and is peculiar to particular technical applications such as use in the melting of metals in EAF furnaces.

Figure 9:
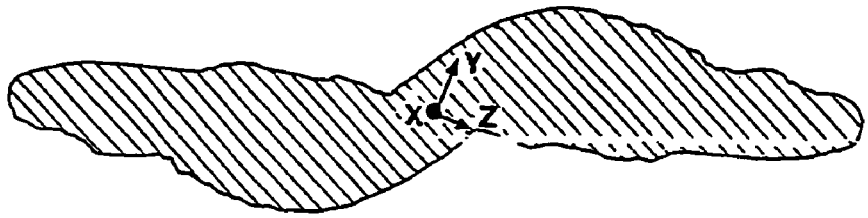
FIG. 9 shows a schematic view of a track of a flat wide flame produced by a further embodiment of the burner according to the invention.
Figure 10:
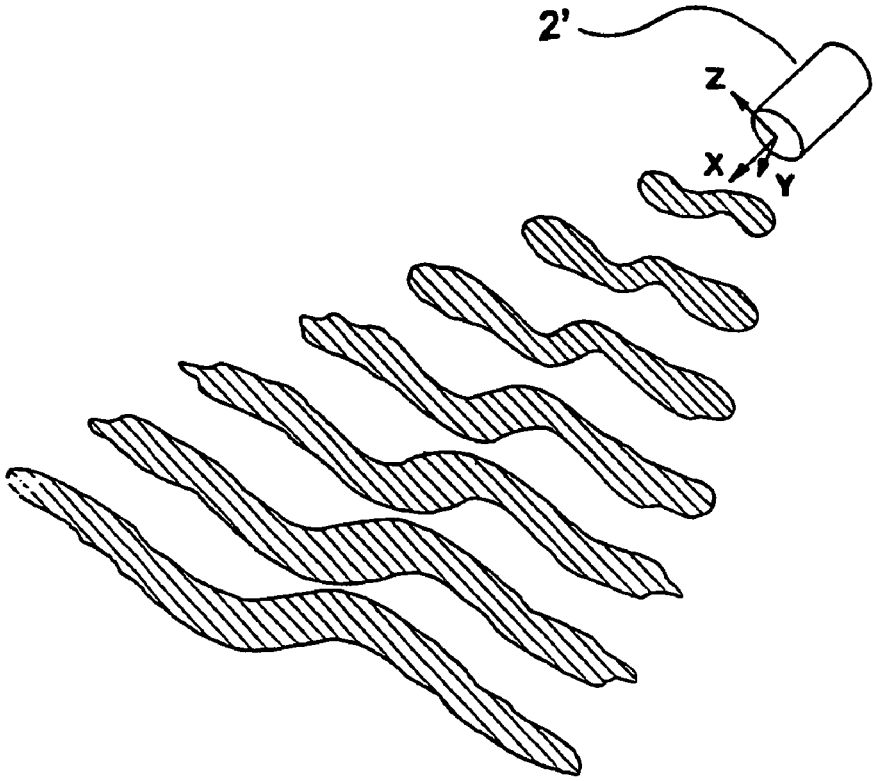
FIG. 10 represents a schematic perspective view of several tracks of the flame of FIG. 9 during its propagation.

FIGS. 9, 10 show schematically a further preferred embodiment of a burner according to the present invention, particularly suitable for generating wide and flat flames. In this embodiment, the holes 4', 4" are grouped on the burner head in one or more first groups 5 of holes, with interspaces of angle γ, greater than the angle δ, separating two adjacent holes. Preferably two of these first groups 5 of holes are set on the head symmetrically and opposite to each other with respect to the head axis X. The angles α', α" of these holes 4', 4" have values comprised between 5° and 60° and the angles β', β" of the holes 4', 4" have a value of substantially 0°, i.e. the hole axes A are coplanar with the head axis X. Moreover, the holes axes A substantially intersect the burner axis X. The angles α', α" and β', β" are the same as previously defined in the other embodiments described above.

In this manner the two opposite first groups of holes 4', 4" are suitable to produce two flames symmetrical with respect to the axis X and divergent from the head tip so that the two flame axes intersect the axis X of the burner behind the head. For example each hole 4', 4" of the first group is symmetrical with respect to the axis X to another hole 4', 4" of the second and opposite group of holes.

In this embodiment the head 2 is provided also with one or more second groups of holes 5, whose holes 4', 4" are oriented like in the other embodiments previously described, i.e. both angles α', α", β', β" of these hole axes are different from 0° and thus are not coplanar with the axis X of the head 2. The two symmetrical flames interact with each other and produce a flame envelope corresponding to a unique, wide and approximately flat flame, as shown in the FIGS. 9, 10: FIG. 9 shows schematically a cross section of a flat flame obtained with the present embodiment, FIG. 10 shows several cross sections of a propagating flat flame. The two flames of the first group substantially produce the central part of the global flame envelope, whereas the flames of the second group generate the external part of the global flame envelope.

The wide flat flame burner according to the present embodiment in addition to the advantages of the previous embodiments, has the advantage of working a longer time with high efficiency: in fact, as the scrap subsides while melting a conical wide flame tends to become uncovered in its upper part, decreasing the efficiency of the burner during the very final phase of scrap melting. On the contrary the wide flat flame can be directed downwards and can work with maximum efficiency almost until the solid scrap post is completely melt down.

Although in this embodiment there are preferably provided two first groups of holes and two second groups of holes, it is also possible to have a different number of groups for either one of the first or second groups.

The burner according to the invention, as described above, is optimal for use in the iron and steel industry and in other fields, such as those mentioned earlier, as well as all other technical applications that require diffused, non-concentrated heat and therefore a distributed flame.

What is claimed is:

1. Burner (1), suitable to generate a flame comprising a cylindrical body (3) defining a first axis (X) and an extremity, provided with at least one first axial internal conduit for the passage of fuel and at least one second axial internal conduit for the passage of comburent and a head (2), fixed in a coaxial position at the extremity of the cylindrical body (3), having an external surface substantially orthogonal to the first axis (X) and provided with first through holes (4') which allow communication of the at least one first axial internal conduit with the outside environment and second through holes (4") which allow communication of the at least one second axial internal conduit with the outside environment, each of the first and second through holes (4', 4") defining a respective second axis (A), being arranged along concentric circles having their respective centres substantially on the first axis (X), at predetermined reciprocal angular distance (δ), each of the second axes (A) being skewed with respect to said first axis (X) whereby it forms first angles (α', α") greater than zero with respect to the first axis (X) and it intersects a plane, passing through the first axis (X) and through the point defined by the intersection of the axis (A) itself with the external surface of the head (2), at second angles (β', β") characterised in that the first (4') and second (4") through holes are grouped in at least two groups (5), reciprocally separated by circular sectors of predetermined angle (γ), without holes, and wherein the angle (γ) is greater than the reciprocal angular distance (δ).

2. Burner according to claim 1, wherein the first angles (α', α") measure between 5° and 60°.

3. Burner according to claim 1, wherein the second angles (β', β") measure between 5° and 60°.

4. Burner according to claim 1, wherein the at least two groups (5) of holes comprise at least one first and at least one second group of holes, each of which respectively comprise several first (4') and several second through holes (4"), whereby in the first group of holes the second angles (β', β") have a value of 0° and in the second group of holes the second angles (β', β") have a value different from 0°.

5. Burner according to claim 4 wherein the at least one first group of holes are two or more and are placed on the burner head symmetrically with respect to axis (X) so that each of said first group of holes is suitable to produce a respective flame in respective diverging directions substantially symmetrical with respect to said axis (X) and wherein the at least one second group of holes are two or more and are placed on the burner head symmetrically with respect to axis (X) so that each of said second group of holes is suitable to produce a respective flame in respective diverging directions substantially symmetrical with respect to said axis (X).

6. Burner according to claim 2, wherein the first angles (α') of the first through holes (4') differ from the first angles (α") of the second through holes (4").

7. Burner according to claim 3, wherein the second angles (β') of the first through holes (4') differ from the second angles (β") of the second through holes (4").

8. Burner according to claim 6 or 7, wherein for each through hole (4'), the respective second angle (β') differs from the respective first angle (α").

9. Burner according to claim 8, wherein pairs of holes comprising one first (4') and one second (4") through holes are placed on respective radiuses passing through the first axis (X).

* * * * *